US012104480B2

(12) United States Patent
Wiecek et al.

(10) Patent No.: US 12,104,480 B2
(45) Date of Patent: Oct. 1, 2024

(54) WELLBORE COLLISION AVOIDANCE OR INTERSECTION RANGING

(71) Applicant: Halliburton Energy Services, Inc., Houston, TX (US)

(72) Inventors: Boguslaw Wiecek, Houston, TX (US); Jeffrey James Crawford, Houston, TX (US); Christopher Michael Jones, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 25 days.

(21) Appl. No.: 17/823,222

(22) Filed: Aug. 30, 2022

(65) Prior Publication Data

US 2023/0068217 A1 Mar. 2, 2023

Related U.S. Application Data

(60) Provisional application No. 63/260,697, filed on Aug. 30, 2021.

(51) Int. Cl.

| | |
|---|---|
| ***E21B 44/00*** | (2006.01) |
| ***E21B 7/04*** | (2006.01) |
| ***E21B 47/022*** | (2012.01) |
| ***E21B 49/00*** | (2006.01) |

(52) U.S. Cl.

CPC ..... *E21B 44/00* (2013.01); *E21B 7/04* (2013.01); *E21B 47/022* (2013.01); *E21B 49/00* (2013.01); *E21B 2200/20* (2020.05)

(58) Field of Classification Search

CPC ..... E21B 44/00; E21B 7/04; E21B 47/022; E21B 49/00; E21B 2200/20

See application file for complete search history.

(56) References Cited

U.S. PATENT DOCUMENTS

| | | | |
|---|---|---|---|
| 2013/0191030 | A1 | 7/2013 | Edwards et al. |
| 2014/0165720 | A1 | 6/2014 | Edwards et al. |
| 2015/0204996 | A1 | 7/2015 | Dashevsky et al. |
| 2016/0041296 | A1 | 2/2016 | Ahmad et al. |
| 2017/0009566 | A1* | 1/2017 | Fan ..... G01S 19/13 |
| 2018/0080310 | A1* | 3/2018 | Sorenson ..... E21B 44/005 |
| 2020/0291766 | A1 | 9/2020 | Kuckes et al. |

OTHER PUBLICATIONS

International Search Report and Written Opinion dated Dec. 20, 2022 for corresponding PCT Patent Application No. PCT/US2022/075658 filed on Aug. 30, 2022.

(Continued)

*Primary Examiner* — Dany E Akakpo
(74) *Attorney, Agent, or Firm* — K&L Gates LLP

(57) ABSTRACT

Surface tracking systems and methods for tracking a first wellbore relative to a non-geological target in a subterranean formation by determining characteristics of gravity anomalies related to the first wellbore and the non-geological target. The system includes a gravity sensor located at the Earth's surface and an information handling system operable to analyze the first and second gravity anomalies to determine a position and the trajectory of the first wellbore relative to the non-geological target. The systems and methods may also include the ability steer a trajectory of the first wellbore relative to the non-geological target.

20 Claims, 2 Drawing Sheets

(56) References Cited

OTHER PUBLICATIONS

Bongs, Kai, et al., "Taking atom interferometric quantum sensors from the laboratory to real-world applications", Nature Reviews—Physics, Dec. 2019, vol. 1, pp. 731-739.
Mukherjee, Anirban, et al. "Conceptualization, Design and Prospects of Atom-Interferometry Based Full Tensor Gravity Gradiometer", Fontiers in Optics/Laser Science @ OSA 2019, 2 pages.
Kumar, Ravi, et al., "Cold atom interferometry for inertial sensing in the field", Adv. Opt. Techn. Aug. 31, 2020; 9(5):221-225, https://doi.org/10.1515/aot-2020-0026.

* cited by examiner

WELLBORE COLLISION AVOIDANCE OR INTERSECTION RANGING

BACKGROUND

This section is intended to provide relevant background information to facilitate a better understanding of the various aspects of the described embodiments. Accordingly, these statements are to be read in this light and not as admissions of prior art.

Wellbores drilled into subterranean formations may enable recovery of desirable fluids (e.g., hydrocarbons) using any number of different techniques. When drilling into a subterranean formation, it may be desirable to drill one or more adjacent wellbores in an effort to more efficiently extract the hydrocarbons. In some applications, adjacent wellbores are used and the relative spacing and placement of the wellbores is controlled to maximize production. In an example, non-intersecting wellbores is desirable. Alternatively, in other applications it is desirable to intersect one wellbore with another, for example when drilling a relief well to redirect hydrocarbon production, or when "killing a well" to cease hydrocarbon production. Therefore, systems and methods are desirable that allow for the detection of relative wellbore positions and steering system that allow one wellbore to be avoided or intersected by another wellbore as needed. Currently, drilling operations may rely on surface acoustic and electromagnetic (EM) measurements together with measurements from a bottom hole assembly (BHA) (e.g., accelerometer or pressure sensor measurements) to calculate the wellbore location and trajectory. However, existing methods for calculating the wellbore location and trajectory suffer from inaccuracies, due in part to assumptions about the wellbore geometry and properties of the subterranean formation. Therefore current methods of calculating wellbore trajectory have uncertainty in providing feedback of direction or depth for steerable drilling systems. Further, current methods of tracking wellbore trajectories using electromagnetic measurement techniques are limited to a few thousand feet of true vertical depth (TVD) below the surface because the electromagnetic waves may not penetrate deep into earthen formations and return a signal with enough strength to quantify the BHA trajectory. Thus, a need exists for more accurate position and trajectory measurements of one wellbore relative to another wellbore as well as the ability to perform position and trajectory measurements at a deeper TVD.

BRIEF DESCRIPTION OF THE DRAWINGS

Embodiments of the systems and methods for wellbore collision avoidance or intersection ranging are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
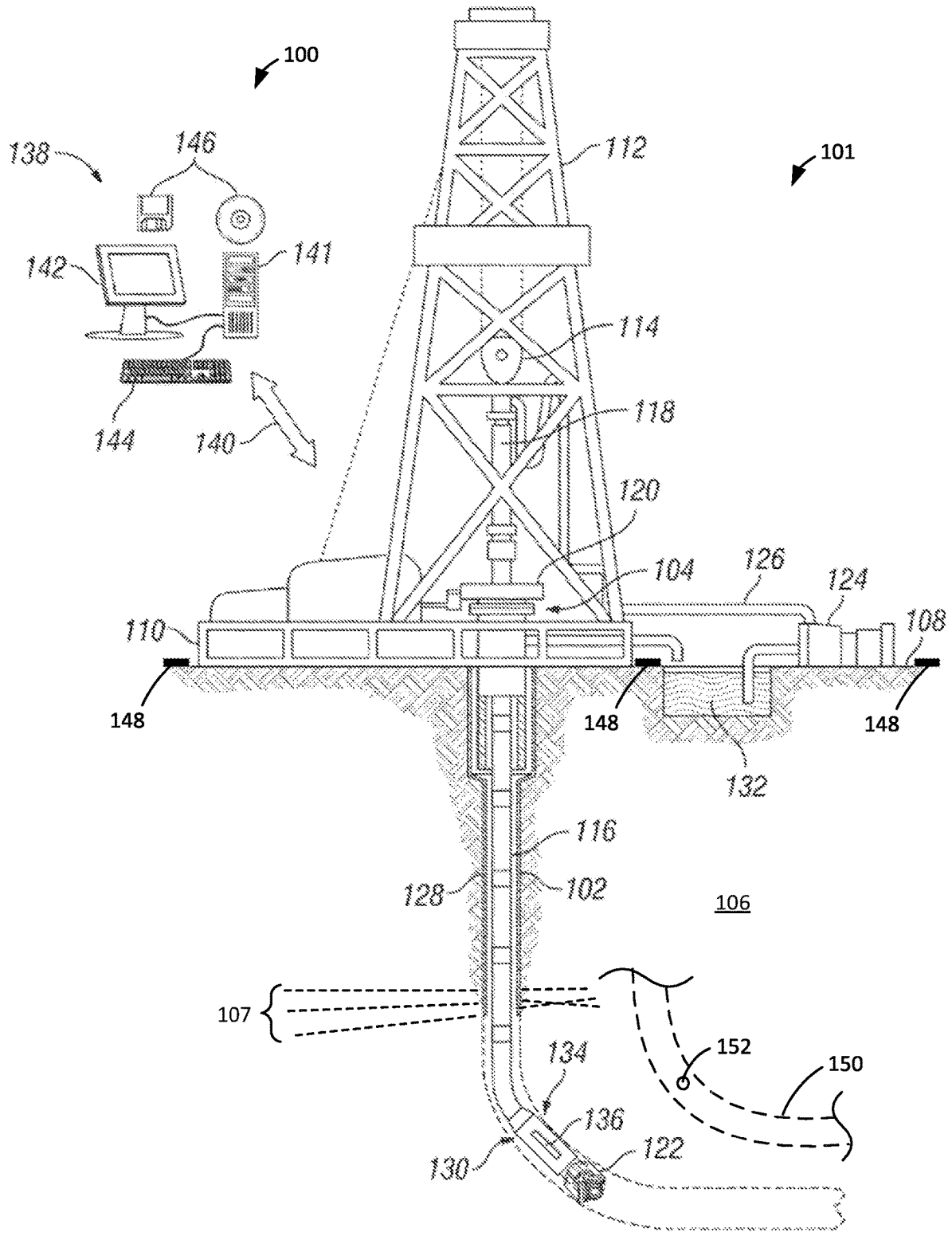
FIG. 1 illustrates an example surface tracking system used with a drilling system for wellbore collision avoidance or intersection ranging, in accordance with the present disclosure.

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

A subterranean formation containing oil or gas hydrocarbons may be referred to as a reservoir, and may be land based or located off shore. Reservoirs are typically located in the range of a few hundred feet (shallow reservoirs) to a few tens of thousands of feet (ultra-deep reservoirs). To produce oil or gas or other fluids from the reservoir, a wellbore is drilled into a reservoir or adjacent to a reservoir.

A well can include, without limitation, an oil, gas, or water production well, or an injection well. As used herein, a well includes at least one wellbore having a wellbore wall. A wellbore can include vertical, inclined, and horizontal portions, and it can be straight, curved, or branched. As used herein, the term wellbore includes any cased, and any uncased, open-hole portion of the wellbore. A near-wellbore region is the subterranean material and rock of the subterranean formation surrounding the wellbore. As used herein, a well also includes the near-wellbore region. The near-wellbore region is generally considered to be the region within approximately 100 feet (30.5 m) of the wellbore. As used herein, "into a well" means and includes into any portion of the well, including into the wellbore or into the near-wellbore region via the wellbore.

A portion of a wellbore may be an open-hole or cased-hole. In an open-hole wellbore portion, a tubing string may be placed into the wellbore. The tubing string allows motive fluids to be introduced into or flowed from a remote portion of the wellbore. In a cased-hole wellbore portion, a casing is placed into the wellbore that can also contain a tubing string. A wellbore can also contain an annulus, such as, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

The system of the present disclosure will be described below such that the system can be used to detect a wellbore or direct a drill bit in drilling a wellbore, such as a subsea well or a land well. However, it will be understood that the present disclosure is not limited to only drilling an oil well. The present disclosure also encompasses natural gas boreholes, other hydrocarbon boreholes, or boreholes in general. Further, the present disclosure may be used for the exploration and formation of geothermal boreholes intended to provide a source of heat energy instead of hydrocarbons.

This disclosure relates generally to surface tracking systems and methods of using gravity sensors to steer the trajectory of a first wellbore relative to a non-geological target. More particularly, this disclosure relates to surface tracking systems and methods for avoiding or intersecting the first wellbore relative to a second wellbore including the non-geological target in a subterranean formation. The surface tracking systems use the gravity sensors to determine characteristics of gravity anomalies related to the first wellbore, the non-geological target, and the second wellbore. Gravity anomalies represent a deviation in a gravitational field caused by a change of properties within a local region of the subterranean formation. For example, a gravity anomaly may be due to the first wellbore being drilled into the subterranean formation or due to changes to the contents within the first wellbore. Without limitation, changes to the contents within the first wellbore include adding or removing the drillstring, the movement of the drillstring, or the introduction of low density pills and or high density pills within the wellbore.

To measure the local changes to the gravitational field from the gravity anomaly, the surface tracking system includes one or more gravity sensors positioned at the surface of the wellbore. In an example, the gravity sensors may be quantum gravity sensors that provide resolution of micro-G to nano-G measurements. Although the disclosure describes the uses of quantum gravity sensors, other gravity sensors such as fiberoptic gravity sensors are also contemplated and may be used in combination with or as an alternative to quantum gravity sensors. Overall, the surface tracking systems disclosed have the ability to determine the positions of the wellbore and/or contents within the wellbore to a depth of up to and greater than 2,000 feet and in some instances up to 10,000 feet true vertical depth (TVD).

As described further herein one or more gravity anomalies may also be included in models of a subterranean formation, and the gravity profile from the model can be compared against the measurements of the gravity anomaly by the gravity sensors. In particular, the gravity anomaly measurements may be used as constraints for an inversion algorithm used to produce the model of the subterranean formation. The inversion algorithm is an iterative mathematical process by which sets of input data (e.g., data that is measured, estimated, assumed, etc.) are used to produce a model of the subterranean formation. The model may be represented numerically or may be generated into a two or three-dimensional model of the subterranean formation. An inversion algorithm may start with an initial model of the subterranean formation, wherein the data describing the subterranean formation comprises, e.g., a number of strata layers, thicknesses of the strata layers, a density of each layer, the material comprising each layer, the porosity of the layers, and the properties of the materials filling the porosity within the layers. In an example, the initial model may be based on the number of strata layers, and a randomly assigned density value for each layer. Alternatively, rather than randomly assigned values, arbitrarily assigned values, or predetermined values based on expectations, the initial model may be based on actual measured or observed data of the formation.

The inversion algorithm uses one or more governing equations of a forward model to simulate signals produced by an earth model. The earth model may be used with physical, stochastic, empirical or correlative equations to forward model multiple signals such as but not limited to gravity signals, acoustic signals, or magnetic signals in the borehole or at surface. The governing equations of the inversion algorithm use the input data and the model of the subterranean formation to produce simulated data (i.e., modeled data) that represents properties of the subterranean formation. The accuracy of the modeled data can then be compared against measured data to assess the overall accuracy of the earth model and further assess the accuracy of the input data. Without limitation, examples of constraining measurements comprise dimensional measurements of the well, densities within a well, seismic measurements from acoustic sensors, gravity measurements from gravity sensors, magnetic measurements from magnetic sensors at the surface or downhole. Further, downhole additional measurements may be made that may provide information beneficial for the earth model. Downhole acoustic, electromagnetic, NMR, nuclear, and formation testing measurements may be made. Any earth model derived should also be consistent with borehole measurements of the well being drilled or offset wells and outcrops. For instance density of formations determined by gravity and or acoustic surface measurements should be consistent with density measurements made in layers of the earth downhole at the intersection of the borehole(s). If differences exist between the modeled data and the measurements, one or more input data of the earth model may be adjusted, and the forward model (s) are run again. Successive iterations of adjusting the input data and running the inversion algorithm are used until the modeled data substantially matches the measurements as the process of inversion. On each iteration, the modeled data is compared against the constraining measurements. A model is described as converging when the modeled data is consistent with the constraining measurement (to within a threshold value). Without limitation, a typical convergent threshold value is reached when the change in value estimation is better than the corresponding noise level for the signals. Lower tolerances for convergence may be estimated by other means such as a formation model which does not change in depth estimation by more than the desired tolerance with which the bit location needs to be determined. Yet other convergence criteria may be set as an expectation based on experience such as but not limited to changes in a parameter estimation lower than 1 percent. Alternatively, a model is described as divergent when the modeled data is inconsistent with the constraining measurement (to within a threshold value). Without limitation, a divergent threshold value is generally greater than at least 5 percent. However divergence and or convergence may be determined by model sensitivity analysis such as but not limited to a Monte Carlo sensitivity analysis. (i.e., introducing a signal or other variable perturbations into the model to determine the effect on the model with respect to a desired positional precision.)

One way of improving model convergence and/or reduce the number of inversion algorithm iterations is to reduce the uncertainty of the input data by making direct measurements of input data property within the wellbore with sensors on the BHA. However, measurement uncertainty may still only limit the input data to a window of values. The absolute magnitude of the measurement is limited to the resolution and or accuracy of the sensor. In addition there is depth, lateral position, and positional uncertainty of the BHA that may be at times on the order of ten to several hundred feet. Thus, even direct measurements of input data may still only be known to within an experimental uncertainty window and numerical iteration may still be used to adjust the input data as the modeled data and constraining measurements converge.

In addition, the particular constraining measurements chosen may not correspond to a unique combination of input data and thus the model may have more than one solution convergence. In other words, more than one combination of inputs may satisfy the constraining measurements, and thus even the converged modeled data may not accurately represent the properties of the subterranean formation. For example, when the constraining measurements are seismic measurements from acoustic sensors on the surface, the same response may be measured by physically thick strata with high sound velocity and physically thin strata with low sound velocity (e.g., known in the art as velocity-depth ambiguity). Thus, a converged model may need to be compared with yet another constraining measurement to determine which of the converged models is an accurate representation of the subterranean formation. However, collecting additional constraining measurements to augment seismic measurements from surface is frequently not possible or practical because of legal or environmental restrictions. Downhole measurements may augment seismic information but come with an inherent ambiguity, resolution and accuracy of those respective measurements. Such subsurface measurements may include wellbore acoustic, nuclear, electromagnetic, nuclear magnetic resonance, image, and formation test measurements. Additionally or alternatively, the constraining measurements for the model may be a gravity anomaly of known density and size that is introduced into the subterranean formation and measured by gravity sensors. As described further herein, the gravity profile modeled from the model may then be directly compared to the constraining measurement of the known gravity anomaly and a unique and convergent solution can be determined. By producing a converged model, the values of the input data are confirmed, and the modeled data of the model can more reliably be used.

In an example, the input data may comprise densities of the various strata, and thus the strata densities may be iteratively adjusted as input data into the inversion algorithm. On each iteration of strata density, a model is produced that models a gravity profile of the subterranean formation. In addition, the model may include a gravity anomaly representing a change in a gravitational field. The gravity anomaly may for example represent a change due to a wellbore being added to the subterranean formation or due to changes within the wellbore (e.g., adding contents into the wellbore such as a drillstring or well testing device, moving the contents within the wellbore, pumping through wellbore, etc.). The gravity sensors mentioned above are used to detect the gravity profile both before and after the gravity anomaly and the changes in the measured gravity profile are thus attributable to the gravity anomaly. Gravity sensor measurements have a density-size-distance ambiguity such that changes of a gravitational field can be due to any combination of density, physical size, and distance from the gravity sensor. However, because the density and the physical size of the gravity anomaly are known in the case of an introduced gravity anomaly, the changes in the gravitational field are attributable to the distance. The distance between the gravity sensor and the gravity anomaly are then relatable to depth and/or position of the gravity anomaly depending on the quantity and arrangement of the gravity sensors, as described further herein. With the depth of the gravity anomaly measured by the sensors, the modeled gravity profile may be compared to the constraining measurement of the gravity anomaly depth and a unique and convergent solution can be determined using the inversion algorithm.

In some non-limiting aspects, the inversion algorithm may, for example, successively modify an initial model based on a gradient search technique, such as a Gauss-Newton search method. In an example, an inversion algorithm solution may be a one dimensional solution curve of density versus measurement depth. In some non-limiting aspects, the inversion algorithm may also generate a two dimensional solution curve of density versus measurement depth and or lateral position and or angular position about the wellbore. The model produced by the inversion algorithm may include, for example, modeled density data over distance or distance and angular position. The modeled data may thus include predictions of density at specific spatial positions within the subterranean formation and a prediction of a resulting gravity field at each specific spatial position. Without limitation, the modeled data and the measured data may be compared using a least-squares algorithm. A baseline gravity survey may be taken before introduction of the wellbore or before extending a length of the wellbore, and the baseline gravity survey can be compared to the gravity information after the wellbore is drilled further. The gravity survey may be conducted at multiple locations along the surface to better locate the position of the wellbore.

The inversion algorithm may be run using a number of different models and governing equations with initial sets of input data, each initial model leading to a new modeled data result which may be convergent or divergent (compared to the measured data). Multiple initial models may be run. In some non-limiting examples, hundreds of initial models may be used. For each model, the same or different number of strata may be used and the quantity of stratum (e.g., one, two, three, or any other discrete number) may also be varied as needed.

In some non-limiting aspects, various Bayesian methods may be applied to the inversion algorithm to take advantage of the input data and models from a previously drilled wellbore within the subterranean formation. Bayesian techniques use prior information from another model in order to improve convergence of a current model. For instance knowledge of a likely earth model from seismic data may be considered prior input data such that the gravity inversion is also be consistent with the seismic survey within a tolerance. A co-inversion provides an inversion for instance for seismic and for gravity that are consistent. In the co-inversion situation, the co-inversion provides a better inversion than any individual technique. A Bayesian inversion, may take advantage of a co-inversion, the measurements of the co-inversion techniques being the prior information. However, if the complimentary inversion largely does not take advantage of the gravity inversion or if the complimentary inversion is not significantly improved by the gravity inversion, then the Bayesian inversion may be uni-directional providing a Bayesian constraint to the gravity inversion. Either method may provide large stability, better resolution, and better accuracy to the gravity inversion. The seismic survey provides only one exemplary embodiment to the nature of a Bayesian inversion, and other complimentary inversion techniques may include magnetic surveys, electromagnetic surveys, or other petrophysical or geologic surveys. Information may be inclusive of measurements from logging techniques including Measurement while drilling (MWD), Logging while drilling (LWD), surface data logging (SDL) and wireline methods. Sensors include rock and fluid analysis techniques, nuclear techniques, acoustic techniques, nuclear magnetic resonance (NMR) techniques and electromagnetic (EM) techniques. Approximate knowledge of the wellbore/BHA location may also provide Bayesian information. Without limitation, the gravity measurements may be augmented with wellbore measurements and locations of stratigraphic features, formation boundaries, and fluid contact positions within the wellbore.

In water, the knowledge of the water density column, as made by direct measurements or otherwise calculated for example using salinity, temperature, and pressure, may be used as input data for the inversion algorithm.

Without limitation, the inversion algorithm produced model may model data characterizing the properties of the subterranean formation in terms of density, material composition, strata or formation dimensions including thickness lateral extent and lateral variation, fluids such as water or oil and gas deposits, gravity profile, resistivity, nuclear measurements, and NMR measurements. Information may be obtained from the well being drilled and or offset wells for which the formation information is valid to the well being drilled or outcrops and include earth model information such as paleo environment. One example of paleo environment informing is the positon of a water type environment (e.g., shole, island, beach, bay, delta, and the direction of sedimentation.) Such information may provide information about lateral extent variations of stratigraphic density.

Referring to FIG. 1, a drilling system 101 is shown with a first wellbore 102 that extends from a wellhead 104 into a subterranean formation 106 from a surface 108. The first wellbore 102 may include horizontal, vertical, slanted, curved, and other types of wellbore geometries and orientations. The first wellbore 102 may be cased or uncased. In examples, the first wellbore 102 includes a metallic member. By way of example, the metallic member may be a casing, liner, tubing, or other elongated steel tubular disposed in the first wellbore 102.

As illustrated, the first wellbore 102 extends through the subterranean formation 106. As illustrated in FIG. 1, the first wellbore 102 extends generally vertically into the subterranean formation 106, however the first wellbore 102 may alternatively extend at an angle through the subterranean formation 106, such as horizontal and slanted first wellbores 102. For example, although FIG. 1 illustrates a vertical or low inclination angle well, high inclination angle or horizontal placement of the first wellbore 102 and equipment is possible. FIG. 1 also includes a second wellbore 150 extending into the subterranean formation 106. The second wellbore 150 is formed before the first wellbore 102 and may be produced in the same manner described for the first wellbore 102. The second wellbore 150 may be oriented at any angle relative to the first wellbore 102 and may extend at the same or at a different inclination angle. It should be further noted that while FIG. 1 generally depicts land-based operations, those skilled in the art will recognize that without departing from the scope of the disclosure, the principles described herein are equally applicable to subsea operations that employ floating or sea-based platforms and rigs.

As illustrated in FIG. 1, a drilling platform 110 supports a derrick 112 having a traveling block 114 for raising and lowering a drillstring 116. The drillstring 116 may comprise, but is not limited to drill pipe as generally known to those skilled in the art. A kelly 118 supports the drillstring 116 as it is lowered through a rotary table 120. A drill bit 122 attaches to the distal end of the drillstring 116 and is driven by either by a downhole motor (not shown) and/or via rotation of the drillstring 116 from the surface 108. Without limitation, the drill bit 122 may include, roller cone bits, PDC bits, natural diamond bits, any hole openers, reamers, coring bits, and the like. As the drill bit 122 rotates, the first wellbore 102 extends into and penetrates various subterranean formations 106 and stratigraphic features 107. A pump 124 circulates drilling fluid through a feed pipe 126 through the kelly 118, downhole through an interior of the drillstring 116, through orifices in the drill bit 122, back to the surface 108 via an annulus 128 surrounding the drillstring 116, and into a retention pit 132.

Referring still to FIG. 1, drill pipe of the drillstring 116 begins at the wellhead 104 and traverses the first wellbore 102. The drill bit 122 attaches to a distal end of the drillstring 116 and may be driven, for example, either by a downhole motor (not shown) and/or via rotation of the drillstring 116 from the surface 108. The drill bit 122 may be part of a bottom hole assembly (BHA) 130 at a distal end of the drillstring 116. It should be noted that the BHA 130 may also be referred to as a downhole tool. The BHA 130 may further include tools for look-ahead resistivity applications. As will be appreciated by those of ordinary skill in the art, the BHA 130 may be a measurement-while drilling (MWD) or logging-while-drilling (LWD) system. The BHA 130 may also include measuring equipment and directional drilling rotary steerable systems such as a push-the-bit or point-the-bit systems.

The BHA 130 may comprise any number of tools, transmitters, and/or receivers to perform downhole measurement operations. For example, as illustrated in FIG. 1, the BHA 130 includes a measurement assembly 134. Without limitation, any number of different measurement assemblies, communication assemblies, battery assemblies, and/or the like may form the BHA 130 with the measurement assembly 134. Additionally, the measurement assembly 134 may form the BHA 130 itself. In examples, the measurement assembly 134 comprises at least one transducer 136, which may be disposed at the surface of the measurement assembly 134. Without limitation, the transducers 136 may also be located within the measurement assembly 134. Without limitation, there may be four transducers 136 arranged ninety degrees from each other around the BHA 130. However, it should be noted that there may be any number of transducers 136 disposed along the BHA 130 at any degree from each other. Without limitation, the transducers 136 may be made of piezo-ceramic crystals, or optionally magnetostrictive materials or other materials that generate an acoustic pulse when activated electrically or otherwise. In examples, the transducers 136 also include backing materials and matching layers. It should be noted that the transducers 136 and assemblies housing the transducers 136 may be removable and replaceable, for example, in the event of damage or failure. Without limitation, the transducers 136 may alternatively be electromagnetic sensors. In examples, the BHA 130 includes one or more additional components, such as analog-to-digital converter, a filter and an amplifier, among others, that may be used to process the measurements of the BHA 130 before they are transmitted to the surface 108.

As an example, the transducers 136 function and operate to generate an acoustic pulse that travels through wellbore fluids. The transducers 136 further sense and acquire the reflected acoustic wave, which is modulated (i.e., reflected as an echo) by the first wellbore 102 wall. During measurement operations, the travel time of the pulse wave from transmission to recording of the echo is recorded. Based on the speed of sound within the fluid of the first wellbore 102, the echo time is used to determine physical dimensions such as a diameter of the first wellbore 102. By analyzing the amplitude of the echo signal, the acoustic impedance may also be derived.

Referring still to FIG. 1, a surface tracking system 100 comprises an information handling system 138 including a computer 141, a video display 142, a keyboard 144 (i.e., other input devices), and/or non-transitory computer-readable media 146 (e.g., optical disks, magnetic disks) that can store code representative of the methods described herein. As illustrated, the information handling system 138 is disposed at the surface 108 and transmits and receives data with the BHA 130 and with one or more gravity sensors 148 via one or more communication links 140 (which may be wired or wireless, for example). Optionally, the information handling system 138 may communicate with the BHA 130 through a communication line (not illustrated) disposed in (or on) the drillstring 116. In examples, wireless communication may be used to transmit information back and forth between the information handling system 138 and the BHA 130 and between the information handling system 138 and the gravity sensor(s) 148.

The information handling system 138 processes information recorded by the BHA 130 and transmitted to the surface 108. Additionally, and as described further herein, the information handling system 138 also processes information from the gravity sensor(s) 148 to create a model characterizing the subterranean formation 106 and track the trajectory of the first wellbore 102.

Although the information handling system 138 is positioned at the surface 108 in the example of FIG. 1, the information handling system 138 may also be positioned downhole in the BHA 130 and processing may occur downhole. Without limitation, a downhole information handling system may include a microprocessor or other suitable circuitry for estimating, receiving, and processing signals from the BHA 130 and/or the gravity sensor(s) 148. The information handling system 138 may further include additional components, such as memory, input/output devices, interfaces, and the like.

Any suitable technique may be used for transmitting signals from the BHA 130 to the surface 108, including, but not limited to, wired pipe telemetry, mud-pulse telemetry, acoustic telemetry, and electromagnetic telemetry. While not shown, the BHA 130 may include a telemetry assembly that transmits telemetry data to the surface 108 as signals. At the surface 108, transducers (not shown) may convert the telemetry signals into electrical signals for a digitizer (not shown). The digitizer may supply a digital form of the telemetry signals to the information handling system 138 via the communication link 140 for processing by the information handling system 138. Although not shown, one of ordinary skill in the art will appreciate the aspects of including the telemetry assembly in the BHA 130 as well as the digitizer.

The gravity sensor 148 measures a gravitational field about the gravity sensor 148 in all directions thus may be used to determine the positions of gravity anomalies such as a positions of the first wellbore 102, the second wellbore 150, or a non-geological target 152 within the second wellbore 150. The non-geologic target 152 is a target location or a feature location not related to a geological feature (e.g., not related to the stratigraphic feature 107 or a feature of the subterranean formation 106). Without limitation the non-geological target 152 may be casing within the second wellbore 150, fluids introduced into an injection well, or an injection formation. In examples, only the first wellbore 102, the second wellbore 150, or a non-geological target 152 may be described, however one having ordinary skill in the art will appreciate that the systems and methods described are applicable to each of the wellbores 102, 150 and to the non-geological target 152.

The gravity sensor(s) 148 may include, for example, quantum gravity sensors, fiberoptic gravity sensors, or combinations thereof. The gravity sensor(s) 148 are placed at locations at the surface 108 and may be spaced for optimal ranging of the drill bit 122. Generally speaking, each gravity sensor 148 has an approximate hemispherical shaped region (e.g., a "detection window") beneath the gravity sensor 148 where changes in the gravitational field are detectable. The shape of detection depends on the local gravity fluctuations about the gravity sensor. The mass above and beside the gravity sensor may be also determined if not negatable. Depending on the required sensitivity of the analysis, the mass due to the atmosphere may also be accounted for. Thus, the spacing between gravity sensors 148 may be selected so that the detection windows between adjacent gravity sensors 148 overlap. Multiple gravity sensors 148 may be used, or a single gravity sensor 148 that is moved to different positons, as described further herein. At least one gravity sensor 148 positional measurement is used but preferably two or more gravity sensor position measurements 148 at the surface 108 are preferable. Further three or more gravity sensors 148 are preferable. In an example ranging use, a gravity sensor 148 is positioned at the surface 108, proximate the first wellbore 102, and monitors the distance to the drill bit 122. In the presence of a well-defined stratigraphic earth model, one sensor measurement at a measurement location may be sufficient to determine distance, however multiple sensor measurement locations are preferable.

When the surface tracking system 100 is used for offshore applications, the gravity sensor(s) 148 may be positioned above, below, or within the water column. For example, the gravity sensor(s) 148 may be placed on the sea (e.g., ocean or lake) floor or within one or more underwater rovers. Alternatively, the gravity sensor(s) 148 may be positioned within the suspended drilling platform and the inversion algorithm model can account for the properties of the water column.

During operation of the drill bit 122, the length of the first wellbore 102 is extended and the position of the drill bit 122 changes. The gravity sensor 148 makes measurements of a gravity field around the drill bit 122 before extending the length of the first wellbore 102 (i.e., an initial survey) and makes measurements of the gravity field after extending the length of the first wellbore 102 (i.e., a secondary survey). The initial survey and the secondary survey are compared by the information handling system 138 and the difference between the surveys represents the gravity anomaly due to the additional first wellbore 102 length. Generally speaking, gravity measurements by the gravity sensors 148 have a density-size-distance ambiguity such that changes of a gravitational field can be due to any combination of density, physical size, and distance from the gravity sensor 148. However, because the density and the physical size of the first wellbore 102 and/or the contents within the first wellbore 102 (e.g., the drillstring 116, drill bit 122, drilling mud, etc.) are known, the changes in the gravitational field are attributable to the depth of the gravity anomaly. As one embodiment of modeling, the relationship F=Gm1m2/R^2 (relativity may be neglected) where F is the force of gravitational attraction between mass 1 and mass 2, G is the universal gravitational constant, m1 is mass 1, m2 is mass 2 and R is a distance between mass 1 and mass 2. In this fashion, the subsurface may be divided into finite elements each with a volume such that a density within that volume describes the mass of that volume. The composite force due to all subsequent volumes acting on the gravity sensor 148, sensing mass at each location, provides the distance R to be determined and hence the location of the wellbore 102 is determined. In an example, the density of the contents within the first wellbore 102 is measured by a downhole transducer such as the transducer 136 of the BHA 130, and the determination of position within the first wellbore 102 relies in part on the measured density.

When using only one gravity sensor 148, the position of the gravity anomaly is known to be within the dimensionally known detection window of the gravity sensor, so the position and orientation of the gravity sensor 148 relative to the wellhead 104 position can be used to geometrically calculate a range of gravity anomaly depths. Depending on the dimensional size of the detection window for the gravity sensor 148, uncertainty in the absolute depth may exist because the distance from the gravity sensor 148 defines an uncertainty region for which the wellbore may be located rather than a singular discrete point. Thus, additional measurements (e.g., ordinal direction of the first wellbore 102, the first wellbore 102 length, etc.) may also be used to refine the gravity anomaly depth and position calculation. For example, the axillary measurement of first wellbore 102 direction may define a narrowed down segment of the uncertainty region and thus and narrowed range of gravity anomaly depths.

In an example, two gravity sensors 148 may be used to improve the accuracy of the depth calculation for the gravity anomaly. The placement of the two gravity sensors 148 can be chosen such that the detection windows overlap so that the gravity anomaly is detectable by both gravity sensors 148. The distance between each gravity sensor 148 and the gravity anomaly are measured as previously described, however uncertainty in the absolute depth is reduced by comparing the signals from both gravity sensors 148. For example, if each gravity sensor 148 defines an uncertainty region of distances, the overlap between two uncertainty regions defines a smaller geographic region of distance and thus less calculated depth uncertainty. Gravity sensor 148 measurements may be spaced along the surface 108 at multiple locations in order to reduce the uncertainty of the anomaly localities.

Still further, the use of three gravity sensors 148 allows a triangulation or other similar intersection determination along equipotential gravity surfaces, of the gravity anomaly when the placement of the gravity sensors 148 allows for overlapping detection windows. For example, if each gravity sensor 148 defines an uncertainty region of distances between each gravity sensor 148 and the gravity anomaly, the overlap between three uncertainty regions defines a particular and discrete point. Thus, the depth and position of the discrete point for the gravity anomaly can be calculated.

Note that so long as the first wellbore 102 does not significantly change between sequential readings, a single gravity sensor 148 may be moved between a series of sequential positions to take measurements. Thus, the gravity sensor(s) 148 may remain stationary or may be moved throughout the ranging process, although the gravity sensor(s) 148 should be fixed during the measurements. In this manner, one or more gravity sensors 148 may be used to simulate surface tracking systems 100 including additional gravity sensors 148. For instance a single gravity sensor 148 may be moved to a second location or a third location to make the equivalent measurements of a two or three gravity sensor 148 surface tracking system 100.

The surface tracking system 100 may operate to track one or more than one gravity anomaly at a time. Additionally, after detecting a gravity anomaly, the surface tracking system 100 may store the positional information for comparisons against the positions of other separate gravity anomalies. Therefore a first gravity anomaly measured by the surface tracking system 100 can be compared against a second gravity anomaly whether it is measured concurrently in time with the first gravity anomaly or if the second gravity anomaly is measured at a different time relative to the first gravity anomaly. In an example, a model created with an inversion algorithm may store the positions of a plurality of gravity anomalies so that the relative position of one gravity anomaly can be compared to the position of one or more other gravity anomalies. Further, a gravity anomaly associated with the position or trajectory of the first wellbore 102 may be analyzed together with a gravity anomaly from the second wellbore 150, so that the relative positions of the first wellbore 102 and the second wellbore 150 can be determined. By storing the measurements from multiple gravity anomalies in the same model, the multiple measurements may be used together to refine the characterization of the wellbores 102, 150.

A detectable gravity anomaly may also be produced by other changes within a wellbores 102, 150. Additionally, differences between the initial survey and the secondary survey may also be continuously calculated by the information handling system 138 so that the change in the gravity anomaly can be examined as a function of time. As described below, the frequency of changes of the gravity anomaly may be used to accurately identify the gravity anomaly.

Referring still to FIG. 1, gravity anomalies can also be created by sequentially extending and retracting a position of contents within the first wellbore 102. For example, the drillstring 116 position can be sequentially varied and thus cause a variation in the gravitational field at the distal end of the drill bit 122 within the wellbore 102. The extending and retracting of the drill bit 122 may be achieved by manipulating the drillstring 116 from the surface and/or may be achieved as a natural result of tripping into and out of the first wellbore 102 during drilling operations. As such, a gravity survey by the surface tracking system 100 may be timed with tripping activities. Because the extension or retraction rate of the drillstring 116 are known, the rate of change of the gravity anomaly may be measureable by the information handling system 138, and thus may be used to readily identify the location of the gravity anomaly apart from other potential gravity profile changes (e.g., background noise). For example, the frequency of the sequential extension and retraction of the drillstring 116 could be set to a particular frequency that is readily distinguishable from the background noise and the information handling system 138 could be configured to monitor for gravity anomalies at that set frequency. With sequential extension and retraction of the drillstring 116 position, it is anticipated that the position of the drill bit 122 would result in the largest gravity anomaly signal. The drill bit 122 would periodically occupy a particular position and then not occupy that position and thus would produce the largest magnitude gravity anomaly along the first wellbore 102. However, gravity anomalies may also be enhanced at other positions along the wellbores 102, 150. For example, gravity anomalies may be enhanced at a plurality of positions along the wellbores 102, 150 and the measurements of the gravity anomalies may be conducted when tripping in and tripping out of the wellbores 102, 150 with the BHA 130.

Figure 2:
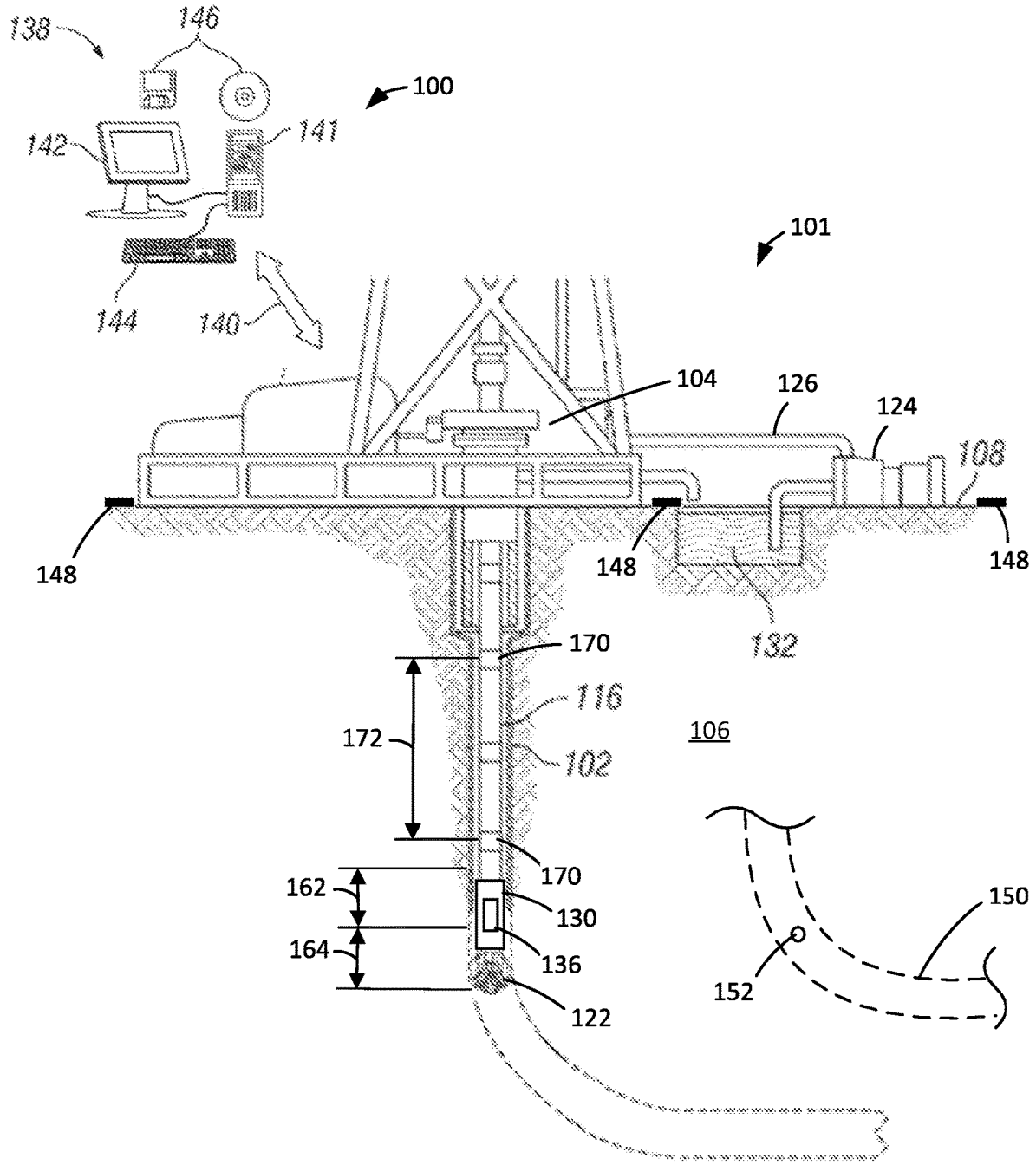
FIG. 2 illustrates the surface tracking system of FIG. 1 in more detail.

Referring to FIG. 2, gravity anomalies can also be created by introducing low density pills 170 within the first wellbore 102. In the example of FIG. 2, the low density pills 170 are fluid or drilling mud with a minimum density to provide wellbore stability and are designed to be compatible with the mud system. Low density pills 170 are fluids of lower density than the surrounding fluid, but limited to a small region in the flow of the mud system. A higher density mud may be used outside the region of the low-density pill 170 to increase the contrast while circulating. The low density pill 170 should maintain its integrity while the mud system is circulating. The integrity of the low density pill 170 can be increased by adding viscosifiers (e.g., to increase the lubricity or viscosity) and or higher surface tension material. The low density pills 170 are introduced into the drillstring 116 at known intervals and pumped downhole within the first wellbore 102. The flow rate of the drilling mud is established by the operational parameters of the pump 124 and so the introduction of the low density pills 170 at a known intervals will coincide with a known distance between the sequentially introduced low density pills 170. The known introduction interval will thus also produce a known frequency of the gravity anomaly change as the low density pills 170 flow past a particular position within the drillstring 116. The known distance between two of the low density pills 170 is shown as a distance 172. The distance 172 can thus be included in the model created by the inversion algorithm, the gravity profile may be modeled, and the gravity profile may be constrained against the gravity anomaly measured by the information handling system 138. The known distance 172 and the known densities of the low density pills 170 thus allow the depths of the low density pills 170 to be calculated by the information handling system 138. Also, because the frequency of the low density pills 170 passing by a set position is known, the rate of change of the gravity anomaly may be readily identified apart from other potential background noise that would be at a different frequency. While the low density pills 170 are described, high density pills may alternatively be used. High density pills would be introduced into the first wellbore 102 in the same manner as described for the low density pills 170 and would have a higher density that the surrounding fluid.

Referring still to FIG. 2, gravity anomalies can also be created by drilling the first wellbore 102 at two different rates over two different lengths shown as distances 162 and 164. The magnitude of the distances 162, 164 may be the same or different with respect to locations along the first wellbore 102. In addition, while the locations of distances 162, 164 are adjacent in the example of FIG. 2, the locations of the distances 162, 164 may also be separated along the length of the first wellbore 102.

During operations of the drilling system 101, an initial gravity survey can be performed before the drill bit 122 extends the length of the first wellbore 102 within the distances 162, 164. The drill bit 122 can then extend the first wellbore 102 length along the distance 162. A secondary gravity survey can then be performed to detect the gravity anomaly along the distance 162. The drill bit 122 can then be made to increase the drilling rate (e.g., by increasing weight on the drill bit 122, increasing the rotational rate of the drill bit 122, or combinations thereof) and the first wellbore 102 length may be extended along the distance 164. Another secondary gravity survey can then be performed to detect the gravity anomaly along the distance 164. The gravity anomalies from the distance 162 is expected to be of a smaller magnitude that the gravity anomaly from the distance 164 and thus the sequence of gravity anomalies form a pattern that may be readily identified apart from other potential background noise.

Overall, by using the surface tracking system 100 to detect gravity anomalies in the manner described, the position and trajectory of the first wellbore 102 relative to the second wellbore 150 is estimated through inversion and may be controlled. If however, the gravity anomalies of the two wellbores 102, 150 are measured as converging the trajectory of the first wellbore 102 may be adjusted to avoid a collision in some instances without knowing the precise location of the wellbores 102, 150. For example, the trajectory of the first wellbore 102 may be manipulated until the gravity anomalies diverge. Note that if the two wellbores 102, 150 approach each other without touching, there still may be negative consequences impacting wellbore 102, 150 stability and or fluid production from the production zones of the wellbores 102, 150. Therefore even near collisions between the wellbores 102, 150 are desirable to avoid in some instances. More specifically, because both wellbores 102, 150 penetrate the same subterranean formation 106, any inaccuracies in gravity measurements and positional calculations may be common and therefore may be similarly offset for both wellbores 102, 150. As a result, a drilling system using the gravity measurements from the wellbores 102, 150 is able to steer the trajectory of the first wellbore 102 to either avoid or intersect the second wellbore 150, with or without calculating an absolute distance or depth for the wellbores 102, 150. Gravity measurements from the surface tracking system 100 may also be recorded in models of the subterranean formation 106 such that the relative positions of the wellbores 102, 150 can be considered relative to the positions of geologic features such as the stratigraphic features 107. As such, the first wellbore 102 may be determined by inversion to be close to a geologic boundary, while not having exact knowledge of position of the geologic boundary or the first wellbore 102. The second wellbore 150 may then also be determined to be close to the geologic boundary, providing a subsurface reference point for the determination of position of the first wellbore 102 relative to the second wellbore 150.

The surface tracking system 100 may be used for steering the drill bit 122 as the gravity sensors 148 provide quantitative data for decision making. Alternatively, an operator may use measurements from the gravity sensors 148 to allow manual control and steering of the drill bit 122. The gravity sensors 148 can measure the position and trajectory of the drill bit 122 relative to the second wellbore 150 or a particular position along the second wellbore 150 such as the non-geologic target 152. Avoidance or intersection of the first wellbore 102 with the second wellbore 150 may be desirable depending on the application. The ability to track and steer the drill bit 122 when using the surface tracking system 100 is not dependent on the first wellbore 102 or the second wellbore 150 total length. Rather, the ability to track and guide the drillstring 116 depends on: the total vertical depth (TVD) of the wellbores 102, 150; the accuracy, placement, and number of gravity sensors 148; and on the subterranean formation 106 properties between the wellbores 102, 150 and the surface 108. Thus, the surface tracking system 100 provides an improved steering and tracking system for use with relatively deep and or long horizontal wellbores 102, 150 where the positional uncertainty (i.e., uncertainty cone) is quite large near the end of the first wellbore 102. Optionally, complimentary techniques of ranging using acoustic or electromagnetic systems positioned at the surface 108 and/or via the transducers 136 on the BHA 130 may also be used together with the gravity sensors 148 to steer the trajectory of the first wellbore 102. For example, the gravity sensors 148 and the surface tracking system 100 may be used to steer the first wellbore 102 near the second wellbore 150, and acoustic or electromagnetic type transducers 136 on the BHA 130 may provide further feedback to steer the trajectory of the first wellbore 102 to either avoid or intersect the second wellbore 150. Electromagnetic ranging may provide location information for tens of feet in advance. Relative position may then be metered using the electromagnetic ranging techniques, while the gravity anomalies are used to further steer the location when outside the electromagnetic ranging capabilities. It should also be noted that the location of a vertical well (or vertical portion of a well) is known with much greater precision than that of a horizontal well (and especially longer horizontal wells). As such, wells with lower location uncertainty such as vertical wells (or the vertical position of a well), may be used to calibrate the location of a gravity inversion.

Additionally, gravity measurements of each wellbore 102, 150 may also be used to constrain models of the subterranean formation 106, and models that converge with the gravity measurements can be more reliably used as an accurate characterization of the subterranean formation 106. Therefore, using the gravity sensor measurements to constrain models can also provide improved modeling of fluids within the subterranean formation 106 including but not limited to fluid type, fluid weight (for example API gravity), fluid contacts, fluid migration (natural or induced), preferential flow paths of fluids, and fluid fronts.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

In addition to the embodiments described above, many examples of specific combinations are within the scope of the disclosure, some of which are detailed below:

Example 1

A method of determining a location of a first wellbore relative to a non-geological target in a subterranean formation, the method comprising:

detecting a first gravity anomaly associated with the first wellbore using a gravity sensor located at Earth's surface;

detecting a second gravity anomaly associated with the non-geological target using the gravity sensor;

analyzing the first and second gravity anomalies with an information handling system to determine a position of the first wellbore relative to the non-geological target; and steering a trajectory of the first wellbore using the position of the first wellbore relative to the non-geological target.

Example 2

The method of Example 1, wherein the first wellbore comprises a drillstring, and wherein detecting the first gravity anomaly further includes sequentially extending and retracting the drillstring within the first wellbore to adjust a density of the first gravity anomaly within the first wellbore.

Example 3

The method of Example 1, wherein detecting the first gravity anomaly further includes flowing a plurality of low density pills through the first wellbore to adjust a density of the first gravity anomaly within the first wellbore.

Example 4

The method of Example 1, wherein detecting the second gravity anomaly associated with the non-geological target comprises detecting a second wellbore.

Example 5

The method of Example 1, further comprising analyzing the first and second gravity anomalies to determine a trajectory of the first wellbore relative to the non-geological target.

Example 6

The method of Example 1, wherein the steering of the first wellbore is controllable to either avoid or intersect the non-geological target.

Example 7

The method of Example 1, further comprising:

detecting a property of the first wellbore or the subterranean formation using a downhole transducer in the first wellbore; and wherein determining the position of the first wellbore relative to the non-geological target further includes analyzing the detected property.

Example 8

The method of Example 1, further comprising:

creating a model of the subterranean formation with an inversion algorithm using input data related to properties of the subterranean formation, wherein the inversion algorithm uses governing equations and the input data to produce modeled data;

constraining the inversion algorithm with a depth of the first gravity anomaly as calculated with at least one of a known dimension of the first wellbore or information of contents within the first wellbore; and predicting a gravity profile from the modeled data including the first and second gravity anomalies.

Example 9

The method of Example 8, wherein the information of the contents within the first wellbore comprises a known density of a drillstring.

Example 10

A system for drilling a first wellbore on a trajectory relative to a non-geological target in a subterranean formation, the system comprising:

a drilling system operable to drill the first wellbore;

a gravity sensor located at Earth's surface operable to detect a first gravity anomaly associated with the first wellbore and a second gravity anomaly associated with the non-geological target;

an information handling system operable to analyze the first and second gravity anomalies to determine a position of the first wellbore relative to the non-geological target; and wherein the system is operable to use the position of the first wellbore relative to the non-geological target to steer the trajectory of the first wellbore.

Example 11

The system of Example 10, wherein the drilling system is operable to sequentially extend and retract contents within the first wellbore to vary a density of the first gravity anomaly.

Example 12

The system of Example 10, wherein the drilling system is operable to flow a plurality of low density pills through the first wellbore to adjust a density of the first gravity anomaly.

Example 13

The system of Example 10, wherein the non-geological target comprises a second wellbore.

Example 14

The system of Example 10, wherein the information handling system is further operable to analyze the first and second gravity anomalies to determine the trajectory of the first wellbore relative to the non-geological target.

Example 15

The system of Example 10, wherein the information handling system is further operable to control the drilling system to steer the trajectory of the first wellbore to either avoid or intersect the non-geological target.

Example 16

The system of Example 10, further comprising:

a transducer downhole operable to detect a property of the first wellbore or the subterranean formation; and wherein the information handling system is operable to analyze the detected property to determine the position and the trajectory of the first wellbore relative to the non-geological target.

Example 17

The system of Example 10, wherein the information handling system is operable to:

create a model of the subterranean formation with an inversion algorithm using input data related to properties of the subterranean formation, wherein the inversion algorithm uses governing equations and the input data to produce modeled data;

predict a gravity profile from the modeled data including the first and second gravity anomalies;

constrain the inversion algorithm with a depth of the first gravity anomaly as calculated with at least one of a known dimension of the first wellbore or information of contents within the first wellbore; and steer the trajectory of the first wellbore to either avoid or intersect the non-geological target.

Example 18

The system of Example 17, wherein information of the contents comprises a known density of a drillstring.

Example 19

A method of drilling a first wellbore through a subterranean formation relative to a second wellbore, the method comprising:

drilling the first wellbore using a drilling system;

detecting a first gravity anomaly associated with the first wellbore using a gravity sensor located at Earth's surface;

detecting a second gravity anomaly associated with the second wellbore using the gravity sensor;

analyzing the first and second gravity anomalies with an information handling system to determine a position of the first wellbore relative to the second wellbore; and controlling a trajectory of the drilling system and the first wellbore relative to the second wellbore based on the position of the first wellbore relative to the second wellbore.

Example 20

The method of Example 19, further comprising:

detecting a property of the first wellbore or the subterranean formation using a downhole transducer in the first wellbore; and wherein determining the position of the first wellbore relative to the second wellbore further includes analyzing the detected property.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method of determining a location of a first wellbore relative to a non-geological target in a subterranean formation, the method comprising:

detecting a first gravity anomaly associated with the first wellbore using a gravity sensor located at Earth's surface;

detecting a second gravity anomaly associated with the non-geological target using the gravity sensor;

analyzing the first and second gravity anomalies with an information handling system to determine a position of the first wellbore relative to the non-geological target; and steering a trajectory of the first wellbore using the position of the first wellbore relative to the non-geological target.

2. The method of claim 1, wherein the first wellbore comprises a drillstring, and wherein detecting the first gravity anomaly further includes sequentially extending and retracting the drillstring within the first wellbore to adjust a density of the first gravity anomaly within the first wellbore.

3. The method of claim 1, wherein detecting the first gravity anomaly further includes flowing a plurality of low density pills through the first wellbore to adjust a density of the first gravity anomaly within the first wellbore.

4. The method of claim 1, wherein detecting the second gravity anomaly associated with the non-geological target comprises detecting a second wellbore.

5. The method of claim 1, further comprising analyzing the first and second gravity anomalies to determine the trajectory of the first wellbore relative to the non-geological target.

6. The method of claim 1, wherein the steering of the first wellbore is controllable to either avoid or intersect the non-geological target.

7. The method of claim 1, further comprising:

detecting a property of the first wellbore or the subterranean formation using a downhole transducer in the first wellbore; and wherein determining the position of the first wellbore relative to the non-geological target further includes analyzing the detected property.

8. The method of claim 1, further comprising:

creating a model of the subterranean formation with an inversion algorithm using input data related to properties of the subterranean formation, wherein the inversion algorithm uses governing equations and the input data to produce modeled data;

constraining the inversion algorithm with a depth of the first gravity anomaly as calculated with at least one of a known dimension of the first wellbore or information of contents within the first wellbore; and predicting a gravity profile from the modeled data including the first and second gravity anomalies.

9. The method of claim 8, wherein the information of the contents within the first wellbore comprises a known density of a drillstring.

10. A system for drilling a first wellbore on a trajectory relative to a non-geological target in a subterranean formation, the system comprising:

a drilling system operable to drill the first wellbore;

a gravity sensor located at Earth's surface operable to detect a first gravity anomaly associated with the first wellbore and a second gravity anomaly associated with the non-geological target;

an information handling system operable to analyze the first and second gravity anomalies to determine a position of the first wellbore relative to the non-geological target; and wherein the system is operable to use the position of the first wellbore relative to the non-geological target to steer the trajectory of the first wellbore.

11. The system of claim 10, wherein the drilling system is operable to sequentially extend and retract contents within the first wellbore to vary a density of the first gravity anomaly.

12. The system of claim 10, wherein the drilling system is operable to flow a plurality of low density pills through the first wellbore to adjust a density of the first gravity anomaly.

13. The system of claim 10, wherein the non-geological target comprises a second wellbore.

14. The system of claim 10, wherein the information handling system is further operable to analyze the first and second gravity anomalies to determine the trajectory of the first wellbore relative to the non-geological target.

15. The system of claim 10, wherein the information handling system is further operable to control the drilling system to steer the trajectory of the first wellbore to either avoid or intersect the non-geological target.

16. The system of claim 10, further comprising:

a transducer downhole operable to detect a property of the first wellbore or the subterranean formation; and wherein the information handling system is operable to analyze the detected property to determine the position and the trajectory of the first wellbore relative to the non-geological target.

17. The system of claim 10, wherein the information handling system is operable to:

create a model of the subterranean formation with an inversion algorithm using input data related to properties of the subterranean formation, wherein the inversion algorithm uses governing equations and the input data to produce modeled data;

predict a gravity profile from the modeled data including the first and second gravity anomalies;

constrain the inversion algorithm with a depth of the first gravity anomaly as calculated with at least one of a known dimension of the first wellbore or information of contents within the first wellbore; and steer the trajectory of the first wellbore to either avoid or intersect the non-geological target.

18. The system of claim 17, wherein information of the contents comprises a known density of a drillstring.

19. A method of drilling a first wellbore through a subterranean formation relative to a second wellbore, the method comprising:

drilling the first wellbore using a drilling system;

detecting a first gravity anomaly associated with the first wellbore using a gravity sensor located at Earth's surface;

detecting a second gravity anomaly associated with the second wellbore using the gravity sensor;

analyzing the first and second gravity anomalies with an information handling system to determine a position of the first wellbore relative to the second wellbore; and controlling a trajectory of the drilling system and the first wellbore relative to the second wellbore based on the position of the first wellbore relative to the second wellbore.

20. The method of claim 19, further comprising:

detecting a property of the first wellbore or the subterranean formation using a downhole transducer in the first wellbore; and wherein determining the position of the first wellbore relative to the second wellbore further includes analyzing the detected property.

* * * * *